United States Patent [19]

Pleschiutschnigg et al.

[11] Patent Number: 5,004,040

[45] Date of Patent: Apr. 2, 1991

[54] METHOD OF CONTINUOUS CASTING

[75] Inventors: Fritz-Peter Pleschiutschnigg, Duisburg; Lothar Parschat, Ratingen; Hans U. Franzen; Manfred Pfluger, both of Duisburg; Josef Glaser, Düsseldorf, all of Fed. Rep. of Germany

[73] Assignee: Mannesmann Aktiengesellschaft, Düsseldorf, Fed. Rep. of Germany

[21] Appl. No.: 480,099

[22] Filed: Feb. 14, 1990

[30] Foreign Application Priority Data

Feb. 17, 1989 [DE] Fed. Rep. of Germany ..... 3905328

[51] Int. Cl.[5] ..... B22D 11/16; B22D 11/18

[52] U.S. Cl. ..... 164/453; 164/413; 164/449

[58] Field of Search ..... 164/450, 451, 452, 453, 164/449, 413

[56] References Cited

U.S. PATENT DOCUMENTS

| | | | |
|---|---|---|---|
| 2,825,104 | 3/1958 | Jones | 164/453 |
| 3,480,073 | 11/1969 | Wilson | 164/413 |
| 4,186,792 | 2/1980 | Yamada | 164/449 |
| 4,774,999 | 10/1988 | Kraus | 164/453 |

FOREIGN PATENT DOCUMENTS

| | | | |
|---|---|---|---|
| 58-199652 | 11/1983 | Japan | 164/449 |

*Primary Examiner*—Kurt Rowan
*Assistant Examiner*—Rex E. Pelto
*Attorney, Agent, or Firm*—Cohen, Pontani & Lieberman

[57] ABSTRACT

A method of continuously casting steel in which a melt is introduced through a movable immersion nozzle. The method includes the steps of controlling the start of the casting process in connection with the withdrawal of the casting by starting the withdrawal of the casting upon reaching a desired height of the surface of the steel in the mold, and driving the casting from the mold at a desired casting removal speed via a control element in a predetermined manner. Further, the method includes measuring the position of the bath level as it ascends in the mold during the continuous casting and adjusting the position of the immersion nozzle in relation to the ascending bath level from a first position to a desired operating position by changing the position of the distributor. Lastly, the method includes determining the desired operating position of the immersion nozzle with respect to the upper edge of the mold as a function of the temperature of the steel melt, the quality of the steel, the K-value of the solidification of the casting and the bath level, so as to establish, during the casting, a spacing of the outer lower edge of the immersion nozzle between a solidification front of the casting and the bath level.

1 Claim, 1 Drawing Sheet

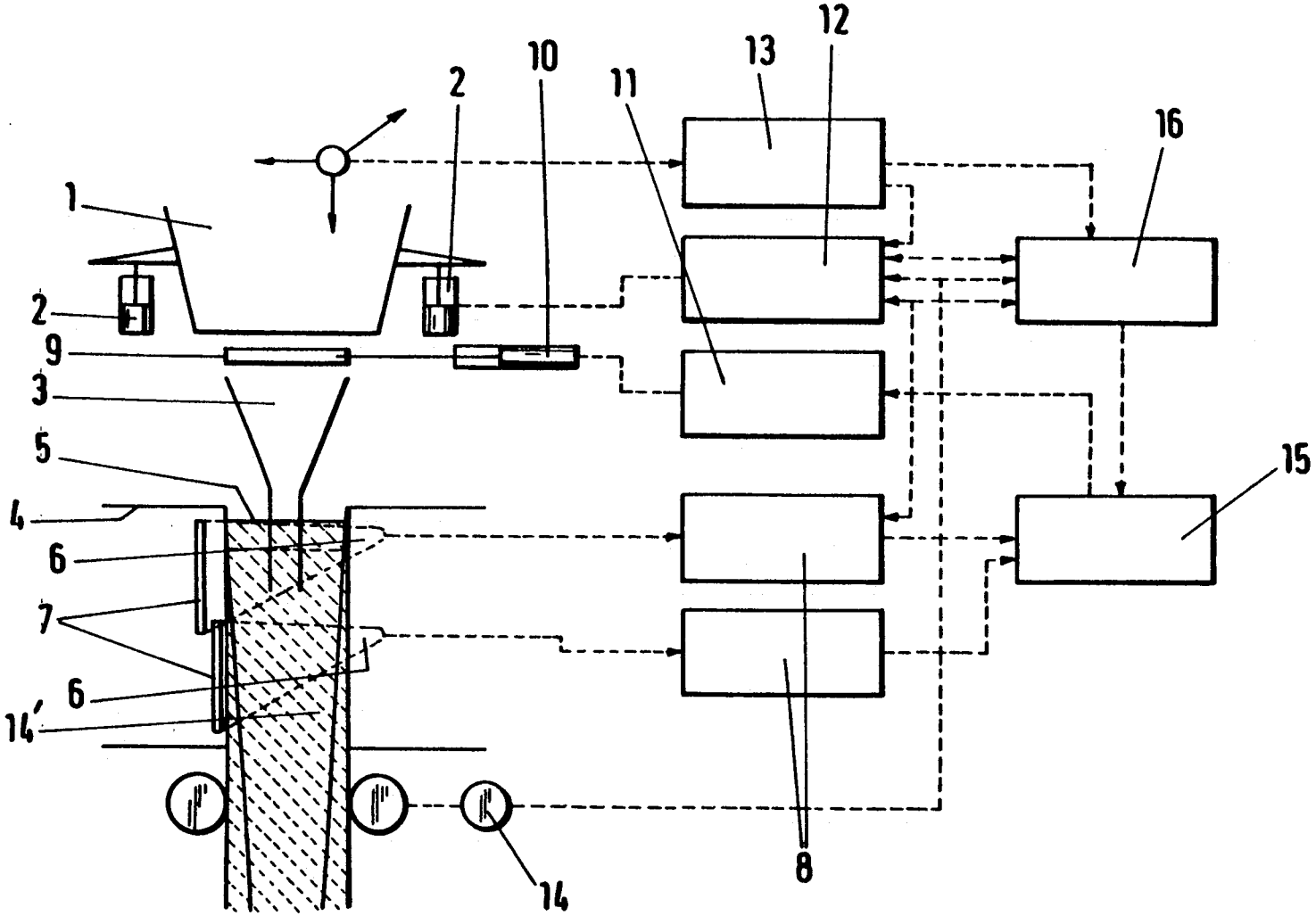
15
16
12
13
11
10
2
8
14
1
2
9
3
5
4
6
7
6
14'

METHOD OF CONTINUOUS CASTING

FIELD OF THE INVENTION

The present invention relates to a method for the continuous casting of steel, and particularly, to a method of continuously casting steel in which a melt is conducted from a distributor through an immersion nozzle into a mold of rectangular cross-section.

BACKGROUND OF THE INVENTION

Upon the continuous casting of flat slabs of steel, proper control of the casting process causes great difficulty. Particularly upon the introduction of the melt through an immersion nozzle which extends into the mold below the bath surface of the casting to be produced, great difficulties in the undisturbed course of the casting process result due to the small distances between immersion nozzle and wall of the mold and the very narrow space available. In particular, there is a danger that the immersion nozzle will come into contact with the solidification front of the shell of the casting and cause damage to it, thus leading to breaks in the casting.

From Swiss Patent No. 619 873, a distributing trough with immersion nozzles and vertical adjustability by means of a lift device is known in which the lift device is program-controlled. The adjustability however serves to fix a given predetermined pouring position of the distributing trough or the immersion nozzle. Furthermore, the plant described there is operated with control of the pouring level. The lift device and adjustment of the pouring level, however, operate independently of each other.

A control device for distributing troughs with immersion nozzles for small billet formats is described in Stahl und Eisen (1988), pages 281 to 285, in which case the casting-on and the displacement in height of the distributing trough during the pouring are included in the control means. The displaceability in height of the distributor is used to control the wear of the immersion nozzle in the slag zone.

From Federal Republic of Germany OS No. 34 23 475 a method of continuous casting is know which uses a controlled starting process and subsequent control of the pouring level. Important parameters of the casting process are controlled or regulated by a casting-shell final thickness calculation in a measurement-value computer. As important parameters it mentions the oscillation of the mold, the amount of flux powder, the quality of the flux powder or also the conicity of the mold.

However, these literature references do not provide any indication of the importance of the distance between the lower edge of the immersion nozzle and the casting shell present in the mold.

SUMMARY OF THE INVENTION

The object of the present invention is to avoid the existing difficulties and to provide a method which enable the undisturbed operation of a continuous casting plant for flat slabs.

This object is achieved by providing a method of continuously casting steel in which a melt is introduced, through a movable immersion nozzle having an outer lower edge, from a movable distributor into a mold of rectangular cross-section having an upper edge, a distance between the broad sides of about 40 to about 100 mm and a distance between the narrow sides of between about 200 and about 2000 mm, and from which mold the casting is withdrawn, the melt introduced into the mold defining a bath of steel therein, said method comprising the steps of:

(a) controlling the start of the casting process in connection with the withdrawal of the casting by
  (1) starting the withdrawal of the casting upon reaching a desired height of the surface of the bath of the steel in the mold, and
  (2) driving the casting from the mold at a desired casting removal speed via a control element in a predetermined manner;

(b) measuring the position of the bath level as it ascends in the mold during the continuous casting;

(c) adjusting the position of the immersion nozzle in relation to the ascending bath level from a first position to a desired operating position by changing the position of the distributor, and (d) determining the desired operating position of the immersion nozzle with respect to the upper edge of the mold as a function of the temperature of the steel melt, the quality of the steel, the K-value of the solidification of the casting, the speed of withdrawal of the casting and the bath level, so as to establish, during the casting, a spacing of the outer lower edge of the immersion nozzle between a solidification front of the casting and the bath level.

BRIEF DESCRIPTION OF THE DRAWING

The carrying out of the method of the present invention require the construction of a plant such as schematically shown in FIG. 1.

DETAILED DESCRIPTION OF A PRESENTLY PREFERRED EMBODIMENT

From a distributor 1 which is vertically adjustable on hydraulic cylinders 2, the steel flows through the immersion nozzle 3 into an ingot mold 4. During the pouring the immersion nozzle 3 extends into the mold 4 to below the surface 5 of the bath. The mold is provided with a bath-level measuring device 8, consisting of transmitters 6 and receivers 7, which is able to monitor the starting process, i.e. the filling of the mold with melt. The filling and further pouring is controlled by a slide-gate closure 9 which is arranged below the distributor 1 and which is adjusted to a given rate of flow by means of a hydraulic cylinder 10. The control is effected by a slide-gate regulation 11. By means of a position regulator 12, the vertical position of the distributor 1 is adjusted by action on the hydraulic cylinders 2. The height regulator 12 cooperates with a measuring device 13 which determines the position in height of the distributor 1. Furthermore, the strand withdrawal speed is measured at 14. The measurement values with regard to the position of the slide-gate, the bath-level in the mold and the transport rolls are fed to a bath level regulator 15 and controlled in accordance with predetermined values by said regulator 15. The bath-level regulator 15, the position regulator 12 of the distributor and the measuring device 13 for the position in height of the distributor are connected to an overriding master controller 16 in which data concerning the temperature of the steel and the quality of the steel are stored. Within this master controller 16, the thickness of the shell of the casting in the mold is calculated in accordance with the formula $$\text{thickness of shell} = K\sqrt{t}$$

and, by default values for the position control 12 of the distributor, the latter follows the casting-shell front 14 during the pouring process in such a manner that a safety distance remains in all cases between the lower edge of the immersion nozzle and the solidification front of the shell of the casting. The factor K takes into account the temperature and quality of the steel as well as the withdrawal speed and the position of the casting level.

The invention can of course also be applied to distributors without stopper or slide-gate control to the amount of melt poured.

It should be understood that the preferred embodiments and examples described are for illustrative purposes only and are not to be construed as limiting the scope of the present invention which is properly delineated only in the appended claims.

What is claimed is:

1. A method of continuously casting steel in which a melt is introduced, through a movable immersion nozzle having an outer lower edge, from a movable distributor into a mold of rectangular cross-section having an upper edge, a distance between the broad sides of about 40 to about 100 mm and a distance between the narrow sides of between about 200 and about 2000 mm, and from which mold the casting is withdrawn, the melt introduced into the mold defining a bath of steel therein, said method comprising the steps of:

(a) controlling the start of the casting process in connection with the withdrawal of the casting by
  (1) starting the withdrawal of the casting upon reaching a desired height of the surface of the bath of the steel in the mold, and
  (2) driving the casting from the mold at a desired casting removal speed via a control element in a predetermined manner;

(b) measuring the position of the bath level as it ascends in the mold during the continuous casting;

(c) adjusting the position of the immersion nozzle in relation to the ascending bath level from a first position to a desired operating position by changing the position of the distributor, and (d) determining the desired operating position of the immersion nozzle with respect to the upper edge of the mold as a function of the temperature of the steel melt, the quality of the steel, the K-value of the solidification of the casting, the speed of withdrawal of the casting and the bath level, so as to establish, during the casting, a spacing of the outer lower edge of the immersion nozzle between a solidification front of the casting and the bath level.

* * * * *